US008011538B2

(12) United States Patent
Herman et al.

(10) Patent No.: US 8,011,538 B2
(45) Date of Patent: Sep. 6, 2011

(54) DISPENSING TOOL

(75) Inventors: Timm Herman, Ellicotville, NY (US); Kevin Whited, Ellicotville, NY (US)

(73) Assignee: Meritool, LLC, Ellicotville, NY (US)

( * ) Notice: Subject to any disclaimer, the term of this patent is extended or adjusted under 35 U.S.C. 154(b) by 241 days.

(21) Appl. No.: 11/973,242

(22) Filed: Oct. 5, 2007

(65) Prior Publication Data

US 2008/0197154 A1 Aug. 21, 2008

Related U.S. Application Data

(60) Provisional application No. 60/902,443, filed on Feb. 21, 2007.

(51) Int. Cl.
*B65D 88/54* (2006.01)

(52) U.S. Cl. ..... 222/326; 222/390; 222/333; 222/391

(58) Field of Classification Search ..... 222/325–327, 222/333, 386, 390
See application file for complete search history.

(56) References Cited

U.S. PATENT DOCUMENTS

| | | | | |
|---|---|---|---|---|
| 3,750,905 | A | 8/1973 | Wolfrom | |
| 4,260,076 | A | 4/1981 | Bergman | |
| 4,583,934 | A | 4/1986 | Hata et al. | |
| 4,669,636 | A | 6/1987 | Miyata | |
| 5,076,473 | A | 12/1991 | Steiner | |
| 5,211,312 | A * | 5/1993 | Chang | 222/153.01 |
| 5,244,406 | A * | 9/1993 | Vranish | 439/362 |
| 5,370,271 | A * | 12/1994 | Segatz | 222/95 |
| 5,375,740 | A | 12/1994 | Umetsu et al. | |
| 5,450,988 | A * | 9/1995 | Jerdee | 222/333 |
| 5,494,368 | A * | 2/1996 | Matthews | 403/259 |
| 5,556,009 | A * | 9/1996 | Motzko | 222/326 |
| 5,775,539 | A | 7/1998 | Bates et al. | |
| 5,873,970 | A | 2/1999 | Konuma et al. | |
| 5,887,765 | A | 3/1999 | Broesamle | |
| 5,909,830 | A | 6/1999 | Bates et al. | |

(Continued)

FOREIGN PATENT DOCUMENTS

EP 1233210 8/2002

(Continued)

OTHER PUBLICATIONS

Milwaukee 14.4V Cordless Caulk & Adhesive Gun Kits, Online Product Sheet, Jun. 25, 2006 (date according to aybackmachine.com) {Retrieved on May 13, 2008} Retrieved from the Internet <URL: http://www.mytoolstore.com/milwauke/6562-21.html>.

(Continued)

*Primary Examiner* — Kevin P Shaver
*Assistant Examiner* — Donnell Long
(74) *Attorney, Agent, or Firm* — Tarolli, Sundheim, Covell & Tummino LLP

(57) ABSTRACT

An apparatus for dispensing material is provided having a body portion and housing for supporting cartridges filled with materials for dispensing. The housing includes a dispensing end, an attachment end, and an elongated opening for receiving the cartridges. The apparatus further comprises an attachment assembly located at an end of the body portion for attaching the housing to the body portion. The attachment assembly includes a first set of threads located about the perimeter of the attachment assembly. A second set of threads are located about the perimeter of the attachment end of the housing for engaging the first set of threads, forming a threaded connection and attaching the housing to the body portion.

25 Claims, 6 Drawing Sheets

U.S. PATENT DOCUMENTS

| | | | | |
|---|---|---|---|---|
| 6,286,729 | B1 * | 9/2001 | Lin | 222/391 |
| 6,745,921 | B2 * | 6/2004 | Beckett | 222/391 |
| 6,752,293 | B2 * | 6/2004 | So | 222/156 |
| 6,889,872 | B2 | 5/2005 | Herman et al. | |
| 6,926,177 | B1 * | 8/2005 | Scott et al. | 222/390 |
| 7,063,240 | B1 * | 6/2006 | Niswonger | 222/391 |
| 2002/0117016 | A1 * | 8/2002 | Beckett | 74/111 |
| 2005/0051571 | A1 * | 3/2005 | Carruth et al. | 222/1 |
| 2008/0083845 | A1 * | 4/2008 | Lind et al. | 239/696 |

FOREIGN PATENT DOCUMENTS

| | | |
|---|---|---|
| JP | 11333346 | 12/1999 |

OTHER PUBLICATIONS

European Search Report, 6 pages, dated Mar. 15, 2010 for EP Application No. EP07862463.

* cited by examiner

DISPENSING TOOL

CROSS-REFERENCES TO RELATED APPLICATIONS

The present application claims priority to U.S. Provisional Patent Application No. 60/902,443 entitled "DISPENSING TOOL", filed Feb. 21, 2007. The entirety of the aforementioned patent application is incorporated herein by reference for all purposes.

TECHNICAL FIELD

The present invention relates to a dispensing tool, and is particularly directed to a power dispensing tool have a quick connect cartridge support assembly.

BACKGROUND

It is common practice for a user to own several different sizes of manual dispensing guns for dispensing materials, such as adhesives, lubricants, and sealants, for example silicone and caulk. One reason for owning several different sizes of manual dispensing guns is to accommodate different sizes of cartridges. It is impractical because of the cost associated with power dispensing guns to own or purchase several different sizes in order to accommodate the different sizes of cartridges.

SUMMARY OF THE INVENTION

In accordance with one exemplary embodiment of the present invention is an apparatus for dispensing materials having a body portion and housing for supporting cartridges filled with materials for dispensing. The housing includes a dispensing end, an attachment end and an elongated opening for receiving the cartridges. The apparatus further comprises an attachment assembly located at an end of the body portion for attaching the housing to the body portion. The attachment assembly includes a first set of threads located about the perimeter of the attachment assembly. A second set of threads are located about the perimeter of the attachment end of the housing for engaging the first set of threads, forming a threaded connection and attaching the housing to the body portion. A locking assembly secures the threaded connection between the first set of threads and the second set of threads to a locked position.

In accordance with another exemplary embodiment of the present invention is a dispensing tool for dispensing materials comprising a housing for supporting cartridges filled with materials for dispensing. The housing has a dispensing end and an attachment end. The dispensing tool further includes a body portion having an attachment assembly comprising a cap, washer, and connector for attaching the housing to the body portion. The cap has a first set of threads and the connector comprises a threaded portion that extends through openings in the washer and the cap into a corresponding threaded area of the body portion for attaching the washer and cap to the body portion. A second set of threads are located about the perimeter of the attachment end of the housing for engaging the first set of threads, forming a threaded connection and attaching the housing to the body portion. A locking assembly is provided for securing the threaded connection between the first set of threads and the second set of threads to a locked position.

In accordance with a further exemplary embodiment of the present invention is a power dispensing tool for dispensing materials comprising a body portion having a handle, trigger, engagement member, and elongated rod connected to a piston such that advancement of the trigger advances the elongated rod through the body portion for the dispensing of material from the power dispensing tool. The dispensing tool further comprises a cartridge support tube for housing materials for dispensing. The cartridge support tube has a dispensing end and an attachment end. An attachment assembly comprising a cap, washer, and connector is provided for attaching the cartridge support tube to the body portion. The cap has a first set of threads about its internal perimeter. The connector has a threaded portion that extends through openings in the washer and the cap into a corresponding threaded area of the body portion engagement member for attaching the washer and cap to the body portion. A second set of threads are located about the external perimeter of the attachment end of the cartridge support tube for engaging the first set of threads, forming a threaded connection and attaching the cartridge support tube to the body portion. The power dispensing tool further includes a locking assembly for securing the threaded connection between the first set of threads and the second set of threads to a locked position. The locking assembly comprising a projection fixedly attached to the cartridge support tube and an opening located in the attachment assembly such that the projection penetrates the opening when in the locked position.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, in which.

DETAILED DESCRIPTION OF THE PREFERRED EMBODIMENTS

Figure 1:
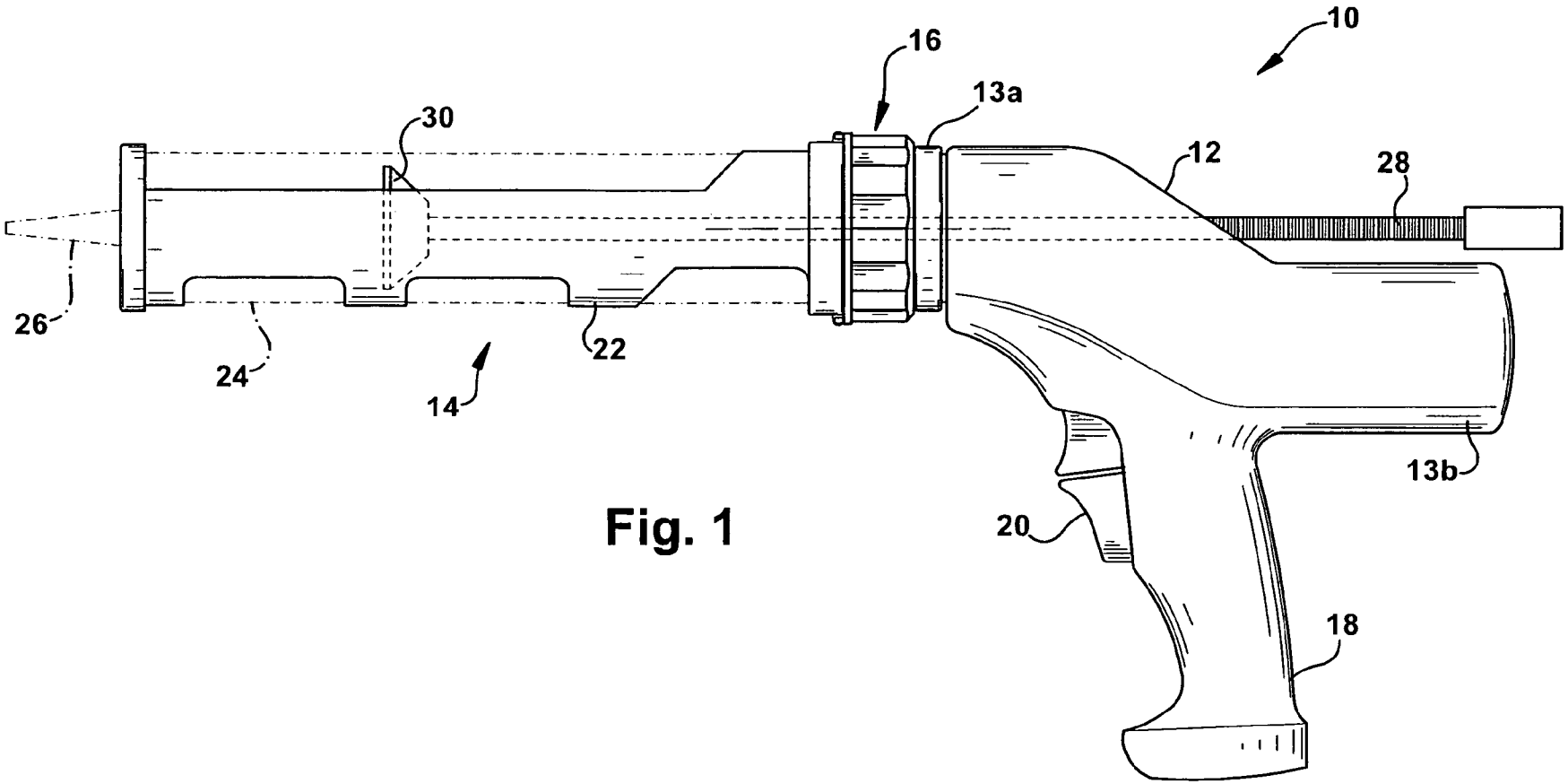
FIG. 1 is an elevation view of a dispensing tool, the tool being equipped with a cartridge support assembly in accordance with one example embodiment of the present invention.

FIG. 1 illustrates a dispensing tool 10 having a body 12 and a cartridge support assembly 14. The cartridge support assembly 14 is attached to the body 12 through its locking assembly 16. The body 12 includes first and second ends 13*a*, 13*b*, respectively, a handle portion 18, and a trigger 20 projecting from the handle portion for engagement by an operator of the dispensing tool 10. The cartridge support assembly 14 further includes a cartridge support tube 22 for supporting a cartridge 24 (shown in phantom) having a dispensing nozzle 26 (also shown in phantom) for dispensing any number of materials, including, but not limited to, adhesives, lubricants, and sealants. The cartridge support tube 22 in the illustrated embodiment of FIG. 1 is molded from a polymeric material, but could also be made from metal and from any other process without departing from the spirit and scope of the claimed invention.

An elongated rod 28 extends from the body 12 and is axially advanced through the body into the cartridge support assembly 14 and cartridge 24 upon activation of the trigger 20. A piston 30 is connected to a forward end of the rod 28, such that axial movement of the rod will cause comparable axial movement of the piston, resulting in the dispensing of material from dispensing nozzle 26 of the cartridge 24 upon advancement.

Motion enabling mechanisms of the rod 28 and piston 30, such as an electric motor, controls and gearing are located within the body for advancement and retraction the rod and piston. In the illustrated embodiment the rod 28 includes a rack or tooth portion for engagement by a pinion of a gear assembly (not shown). Upon engagement of the trigger 20 an internal motor (not shown) would provide movement in the gear assembly, engaging the rod 28 for either advancement or retraction of the rod through the body 12. The motion enabling mechanisms for advancing and retracting the rod 28 and piston 30 through the body 12 could alternatively be achieved by other constructions known by those skilled in the art, such as a screw-gear assembly without departing from the spirit and scope of the claimed invention.

Figure 2:
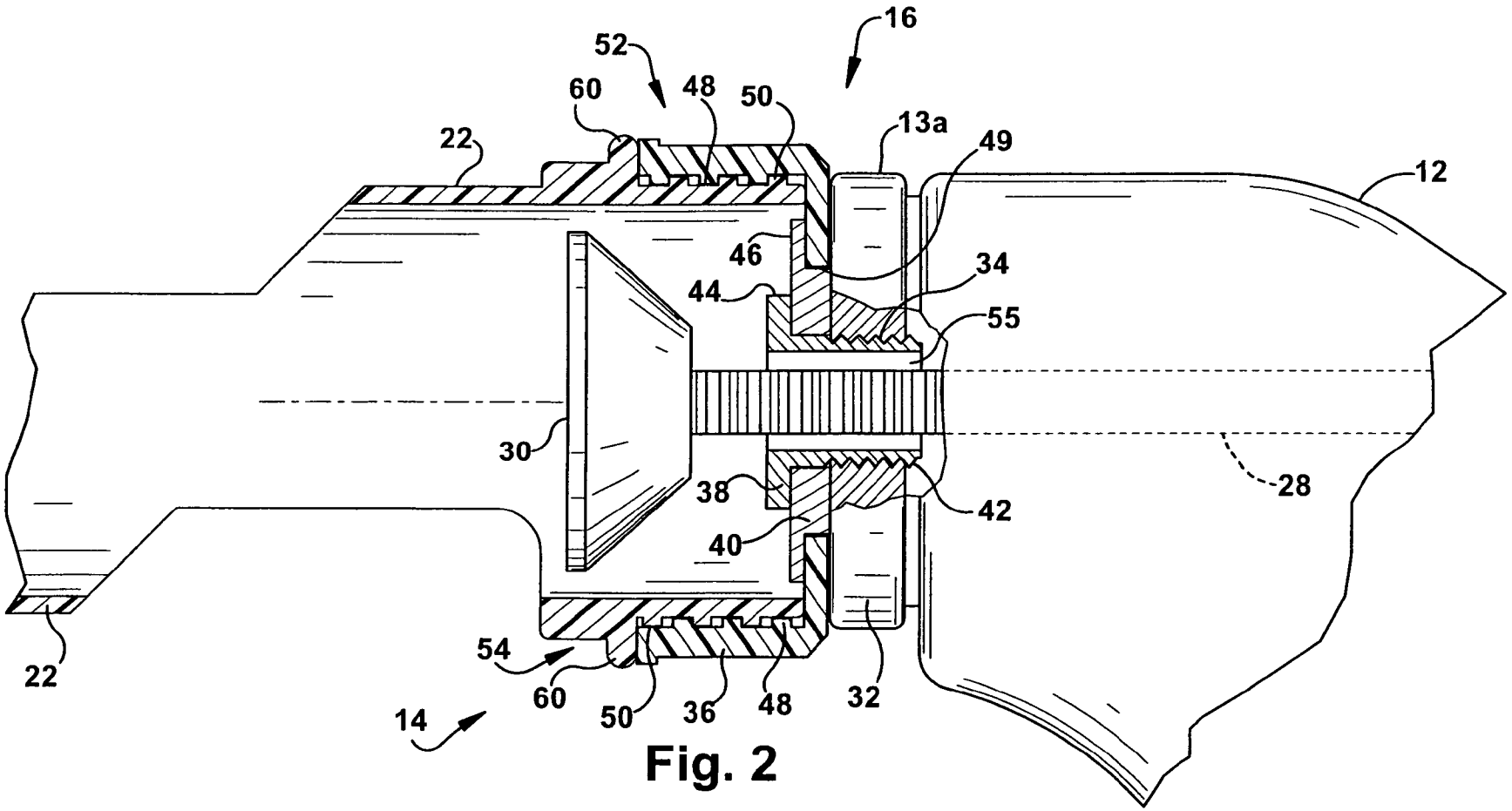
FIG. 2 is a partial-sectional elevation view of a cartridge support assembly attached to the body of the dispensing tool of FIG. 1.

Turning now to FIG. 2 is a partial sectional elevation view of the cartridge support assembly 14 attached to the body 12 of the dispensing tool 10 of FIG. 1. Integrally connected to the body 12 at the first end 13*a* is an engagement member 32 that includes internally tapped threads 34. The locking assembly 16 includes a rotatable cap 36, connector 38, and a step washer 40. The step washer 40 can be made from a metal or polymeric material and is coated with an anti-friction coating to allow for rotation of the cartridge 24, cartridge support tube 22, and rotatable cap 36 during operation. It is desirable to allow the operator of the dispensing tool 10 to rotate the cartridge support assembly 14 and cartridge 24 relative to the body 12 in order to achieve various angles of the dispensing nozzle 26 during application of the dispensing material. Examples of suitable anti-frictional coatings include silicone and Teflon plating. In addition, such construction requires only the cap 36 to rotate in order to attach the cartridge support assembly 14 to the body 12.

The connector 38 includes a threaded member 42 for engaging the engagement member 32 through the mating thread 34 connection. The connector 38 further includes an annular flange 44 that holds the step washer 40 in a secured position. The step washer 40 includes a circular flange 46 for retaining the rotatable cap 36 to the body 12. The anti-friction coating applied to the step washer 40, particularly on the surface of the circular flange 46 facing the rotatable cap 36 enables the desired rotation of the cap 36, cartridge support tube 22, and cartridge 24. The rotatable cap 36 includes receiving threads 48 located about the cap's internal perimeter and a circular opening 49 in which the connector 38 and at least a portion of the step washer 40 passes, permitting attachment of the connector and step washer to the body 12.

Figure 6:
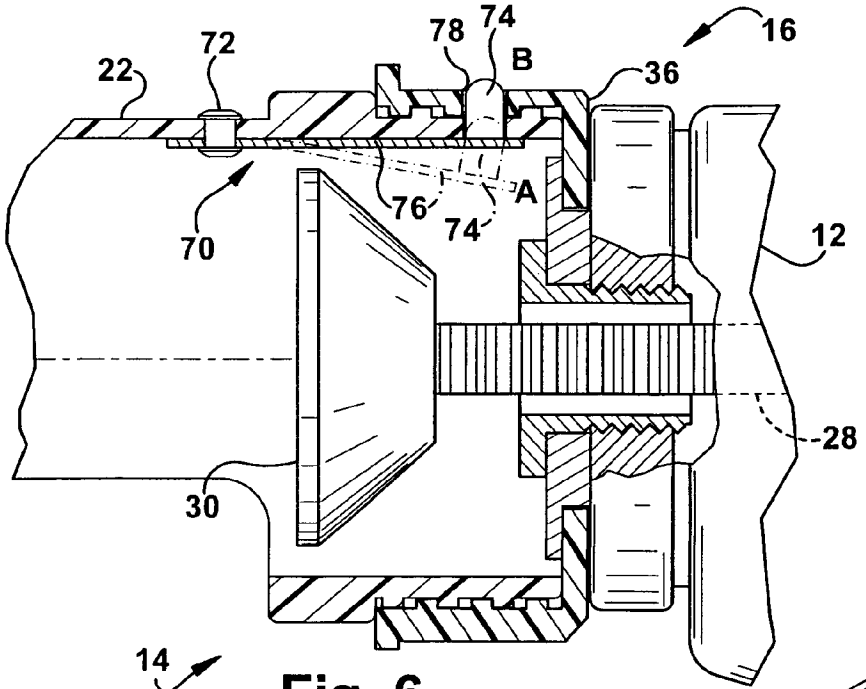
FIG. 6 is a partial-sectional elevation view of a cartridge support assembly attached to the body of the dispensing tool in accordance with another example embodiment of the present invention.

The cartridge support tube 22 includes attachment threads 50 located at an attachment end 52 of the cartridge support assembly 14. The cartridge support assembly 14 is attached to the body 12 through a threaded assembly 54 that includes the connection between attachment threads 50 and corresponding receiving threads 48 located in the rotating cap 36 as best illustrated in FIGS. 2 and 6. The connector 38 provides a clearance opening 55 for the passing of the elongated rod 28.

Figure 3A:
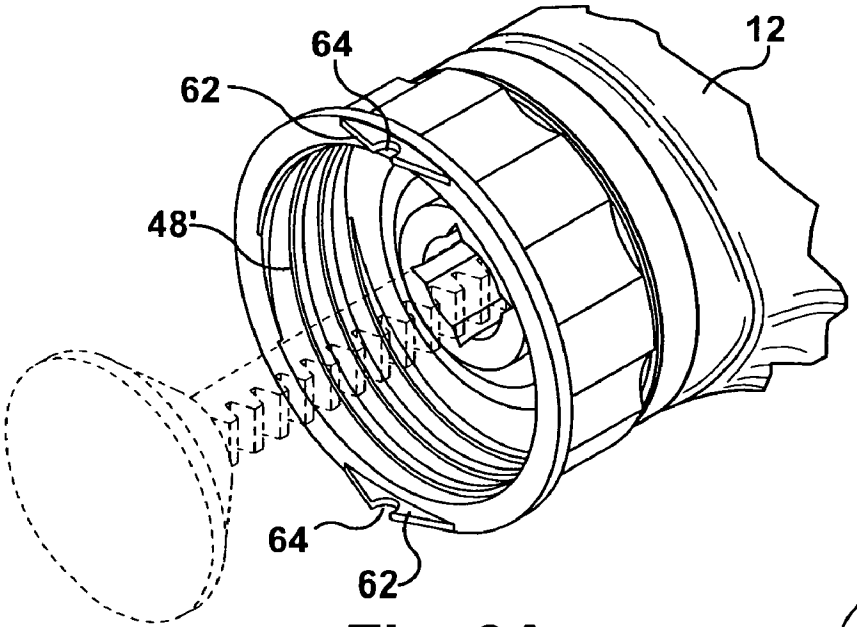
FIG. 3A is a partial isometric view of a dispensing tool body end depicting a locking assembly in accordance with one example embodiment of the present invention.

The threaded assembly 54 in one example embodiment includes a single-lead threaded connection, as depicted by the receiving threads 48' in FIG. 3A. The single-lead thread requires approximately 360 degrees of rotation for complete engagement. In a separate example embodiment the threaded assembly 54 includes a double-lead threaded connection, as depicted by the receiving threads 48" in FIG. 3B requiring half of the rotation necessary for a single-lead thread, that is, approximately 180 degrees of rotation for complete engagement. The threaded assembly 54 connection allows the cartridge support tubes 22 to be interchanged with different support tube sizes rapidly without the use or need for additional tools.

Figures 4, 5:
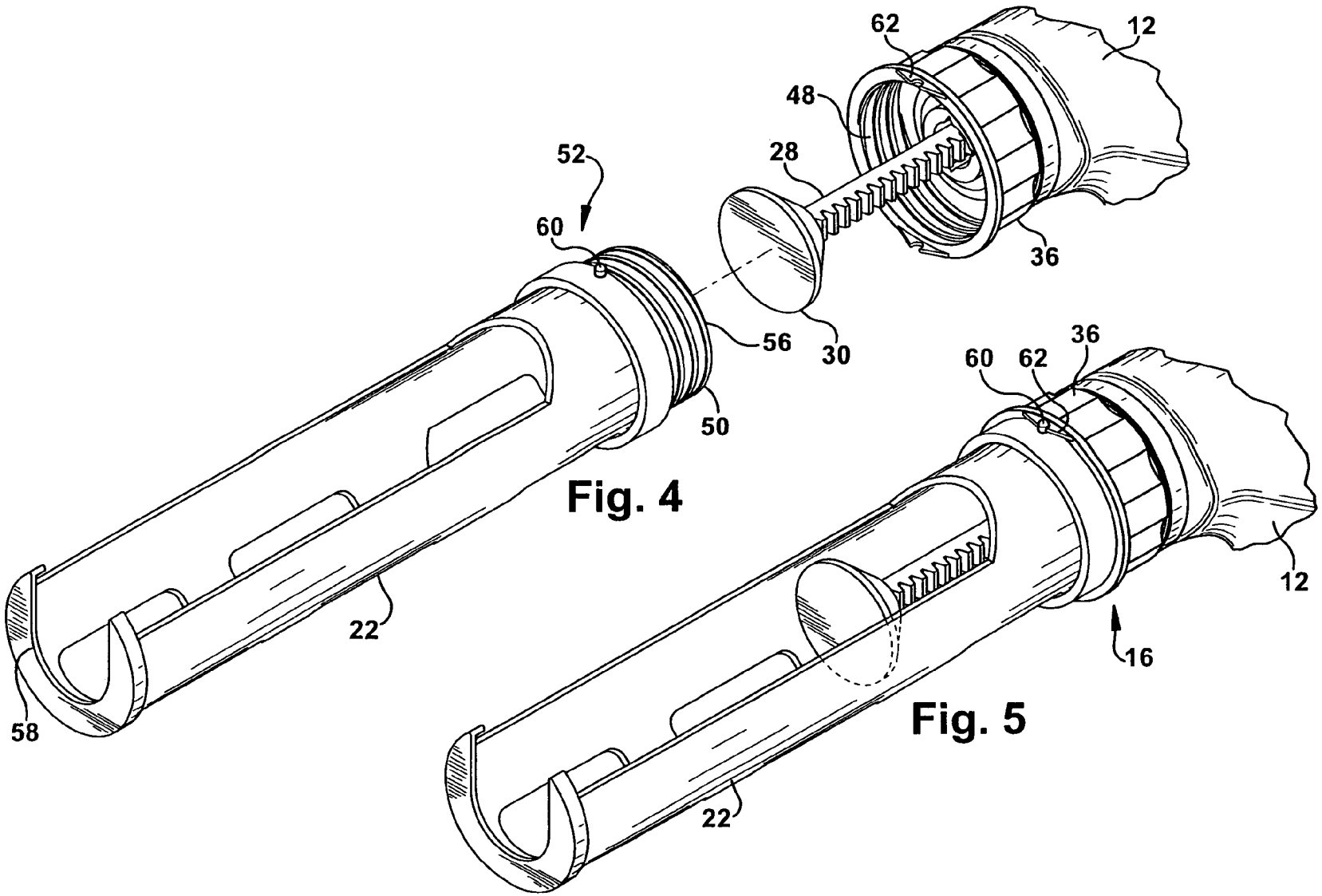
FIG. 4 is an exploded isometric assembly view of the dispensing tool of FIG. 1.
FIG. 5 is a partial isometric view of the dispensing tool of FIG. 4.

FIG. 4 is an exploded isometric assembly view of the dispensing tool 10 of FIG. 1. The cartridge support tube 22 provides an opening 56 at the attachment end 52 for receiving the piston 30, allowing the piston to remain attached to the elongated rod 28 for quick interchanging between support tubes 22. Located at the end opposite the attachment end 52 of the support tube 22 is a slot 58 for receiving the cartridge nozzle 26 upon insertion of the cartridge 24 to the support tube as depicted in FIG. 1. FIG. 5 illustrates the cartridge support tube 22 in an attached position with the body 12.

Figure 3B:
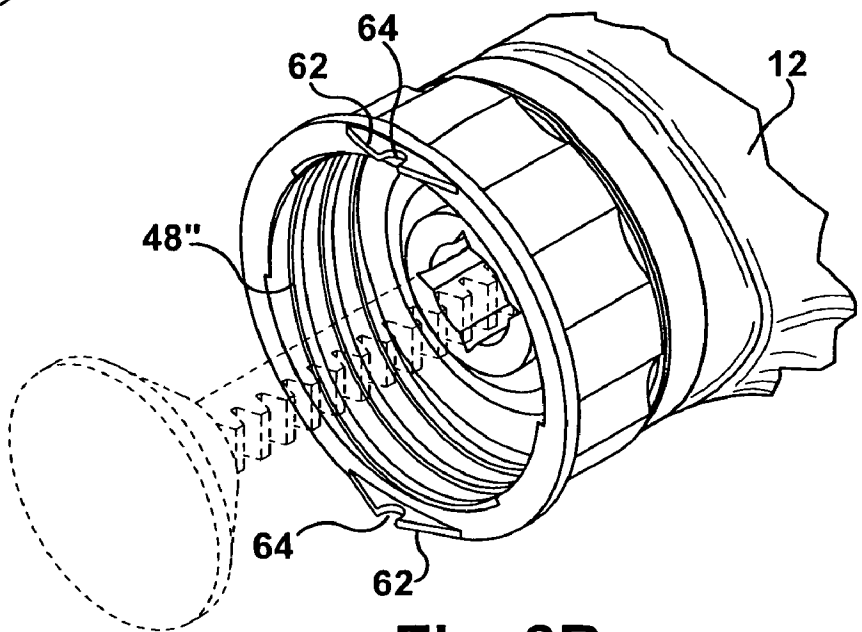
FIG. 3B is a partial isometric view of a dispensing tool body end depicting a locking assembly in accordance with another example embodiment of the present invention.

Referring again to FIG. 2 is one example embodiment of the locking assembly 16 that additionally includes two projections 60, substantially diametrically opposed about the perimeter of the attachment end 52 of the cartridge support tube 22. In the illustrated embodiment the projections 60 are integrally molded with the cartridge support tube 22. The projections 60 contact one side of a respective double inclined latch 62 upon concomitant rotation of the cartridge support tube 22 and/or rotating cap 36 in forming the threaded assembly 54 until engagement is complete. In the illustrated embodiment the double inclined latches 62 are integrally molded with, and extending from the polymeric cap 36. Upon completion of engagement of the threaded assembly 54, the projections 60 are received in a respective arcuate detents 64 (as best seen in FIGS. 3A and 3B) located between the inclines of the latches 62, arriving in a locking position as best seen in FIG. 5. The locking position prevents the disengagement of the threaded assembly 54 and more specifically, the disengagement of the cartridge support tube 22 from the rotating cap 36, unless intentionally acted upon by the user. In order to release the locking assembly 16 from the locking position illustrated in FIG. 5, the projections 60 and/or latches 62 have an elastic composition that allows for displacement from the locking position with the application of force by the user while simultaneously rotating the support tube 22 from the rotating cap 36. In the illustrated example embodiment, the projections 60 and inclined latches 62 are made from a polymeric material, but could also be made from metal or any other material without departing from the spirit and scope of the claimed invention.

FIG. 6 illustrates a second example embodiment of the locking assembly 16 that includes a spring assembly 70 having a first end attached to the cartridge support tube 22 by a fastener 72, such as a rivet or screw or other fasteners recognized by those skilled in the art. At an end of the spring assembly 70 opposite the fastener 72 is a locking protrusile 74, which is attached to, and projects from a spring 76 of the spring assembly. The spring assembly 70 assumes a non-locking position "A" (shown in phantom) prior to engagement of the threaded assembly 54 and during rotation of the support tube 22 and/or rotating cap 36 in the forming of the threaded assembly. Upon completion of the engagement of the threaded assembly 54, the protrusile 74 extends through an aperture 78 of the cap 36 assuming a locking position "B". The spring assembly 70 is made from a polymeric material in the illustrated embodiment, but could equally be made from a metal, including for example spring steel.

The locking position B prevents the cartridge support tube 22 from disengaging the cap 36 unless intentionally acted upon by the user. In order to release the locking assembly 16 of FIG. 6, the user depresses the protrusile 74 from position B to position A while simultaneously rotating the cap 36 from the support tube 22. The protrusile 74 and spring 76 are made from plastic, but could also be made from metal or any other material without departing from the spirit and scope of the claimed invention.

Figure 7:
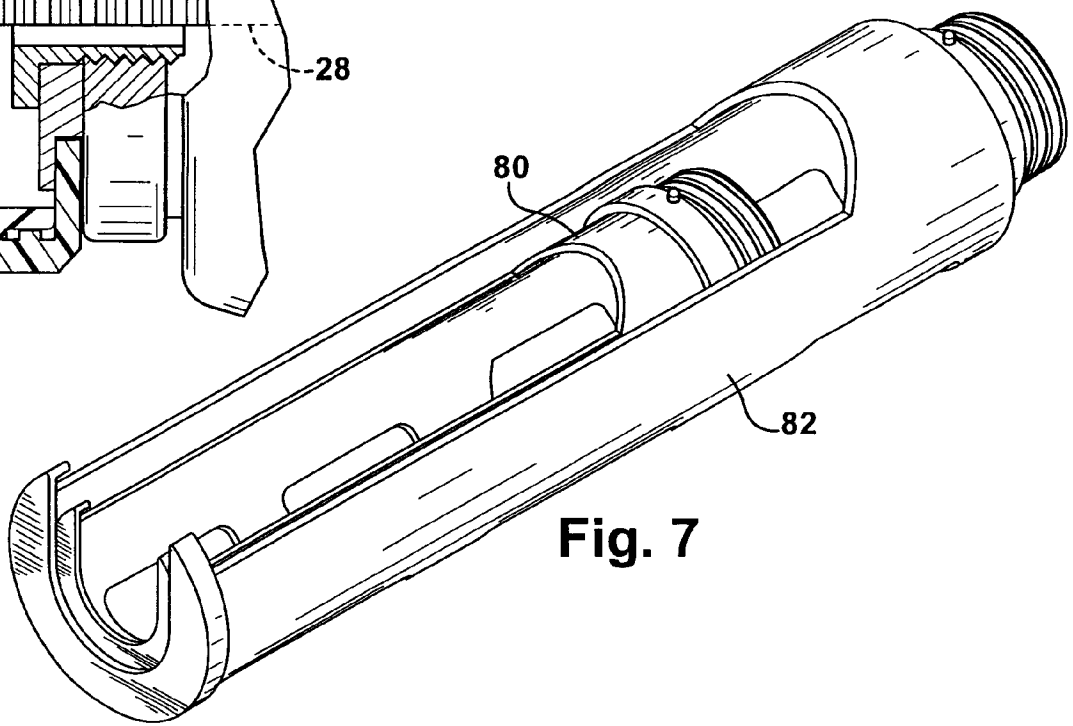
FIG. 7 is an isometric view of two cartridge support tubes in a nested storage position.
Figures 8A, 8B, 8C:
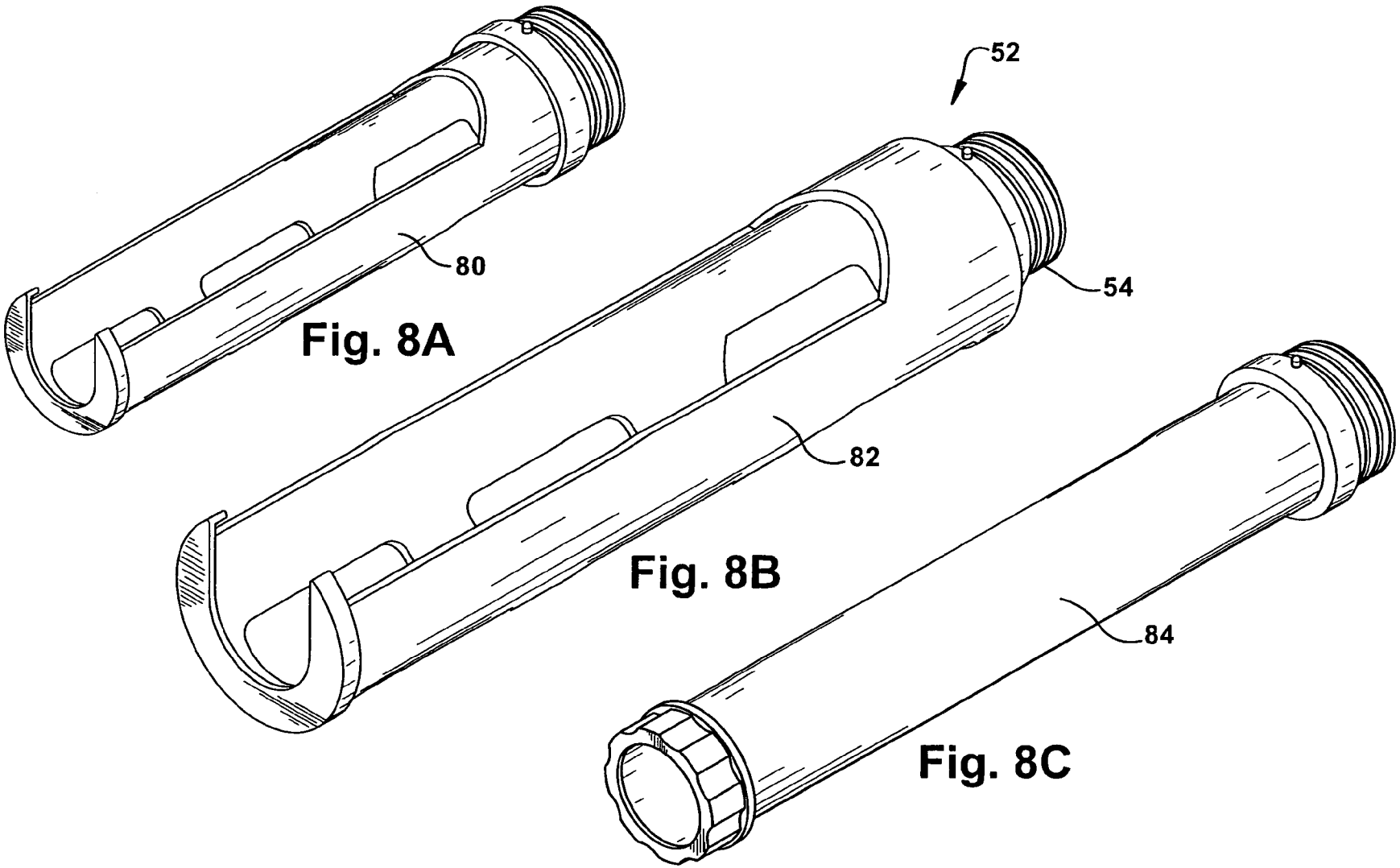
FIGS. 8A-8C are isometric views of different sized cartridge support tubes.

FIGS. 7 and 8A-8C illustrate a variety of cartridge support tubes 80, 82, and 84 of varying sizes, materials and configurations. Cartridge support tube 80 is the smallest of the tubes and is used for approximately 300 milliliter sized cartridges. Cartridge support tube 82 is relatively greater in size and is used for approximately 29 ounce sized cartridges. The cartridge support tube 84 is a sausage type configuration and is used for approximately 300 milliliter and 600 milliliter sized cartridges. All three cartridges include the attachment assembly 54 described above and are capable of being equipped with the different locking assembly 16 embodiments previously discussed. In particular, the support tubes 80-82 are shown having a projection 60 type locking assembly. As illustrated in FIGS. 8A-8C, varying size cartridge support tubes 22 maintain equally sized attachment ends 52 for accommodating uniform threaded assembly 54 attachments. Such construction allows any size cartridge support tube 22 to be used without departing from the spirit and scope of the claimed invention. In the illustrated embodiments of FIGS. 8A and 8B the cartridge support tubes are single-piece molded from a polymeric material and support tube 84 is made from a metal. However, the cartridge support tubes 14, 80-84 can be made from any type of material without departing from the spirit and scope of the claimed invention.

FIG. 7 illustrates a nesting feature between two different sized cartridge support tubes that allows for efficient storage achieved by the design of the claimed invention. Molded features can be added to lock the smaller cartridge tube 80 to the larger tube 82. For example, clips or other locking attachments could be molded such that the larger cartridge tube 82 would have a mating structure for engaging or receiving a corresponding structure in the smaller cartridge support tube 80. The smaller cartridge tube 80 can also be used while in the nested position of FIG. 7. In particular, the smaller cartridge tube 80 can contain a cartridge 24 and be simultaneously secured to the larger cartridge tube 82 in a manner described above, allowing the piston 30 to pass through both the larger and smaller tubes and dispense material from a cartridge 26 positioned in the smaller cartridge tube 80.

From the description of the invention, those skilled in the art will perceive improvements, changes and modifications. In addition to the dispensing tool 10 having a cartridge support tube 22 and locking assembly 16 fabricated from molded polymeric material, one skilled in the art will appreciate that support tube and locking assembly are equally suited for being made from other integrally molded or separate materials without departing from the spirit and scope of the claimed invention. For example, the support tubes 22 and locking assemblies 16 could be made from various metals. Such improvements, changes, and modifications within the skill of the art are intended to be covered by the appended claims.

We claim:

1. An apparatus for dispensing materials comprising:
a body portion;
a housing for supporting cartridges filled with materials for dispensing, the housing having a dispensing end, an attachment end, and an elongated opening for receiving the cartridges;
an attachment assembly located at an end of said body portion for attaching said housing to said body portion, the attachment assembly comprising a first set of threads located about the perimeter of said attachment assembly;
a second set of threads located about the perimeter of said attachment end of said housing for engaging said first set of threads, forming a threaded connection and attaching said housing to said body portion; and
a locking assembly for securing the threaded connection between said first set of threads and said second set of threads to a locked position.

2. The apparatus of claim 1 wherein said locking assembly further comprises at least one projection and at least opening for receiving said projection when in said locked position.

3. The apparatus of claim 1 wherein said locking assembly further comprises at least one projection extending from said housing and at least one latch assembly extending from said attachment assembly, the at least one latch assembly having an arcuate detent for receiving said projection when in said locked position.

4. The apparatus of claim 2 wherein said first set of threads are located about an internal perimeter of a cap and said second set of threads are located about an external perimeter of said housing.

5. The apparatus of claim 4 further comprising a first and a second projection and corresponding to first and second latch assemblies each providing said opening for receiving a respective projection, wherein said first projection and latch assembly is substantially diametrically opposed from said second projection and latch assembly.

6. The apparatus of claim 2 wherein said locking assembly further comprises a spring assembly having a spring fixedly attached at a first end to the attachment end of said housing and said projection extending from a second end of said spring such that rotation of the first and/or second sets of threads allows said projection to extend through said opening when achieving said locked position.

7. The apparatus of claim 1 wherein said first and second set of threads comprise a double-lead thread connection.

8. The apparatus of claim 7 wherein said housing and attachment assembly are made from a plastic material.

9. A power dispensing tool for dispensing material that allows for the interchange of different size housings without the use or need of tools, the power dispensing tool comprising:
a housing for supporting cartridges filled with materials for dispensing, the housing having a dispensing end and an attachment end, and an elongated radial opening for receiving cartridges;
a body portion having an attachment assembly comprising a cap, washer, and connector for attaching the housing to said body portion, the cap having a first set of threads;
a piston connected to a forward end of a rod, the rod passing through said body portion, cap, washer, and connector, the piston engaging and advancing material from the cartridge during operation of power dispensing tool;

the connector having a threaded portion that extends through openings in said washer and said cap into a corresponding threaded area of said body portion for attaching the washer and cap to said body portion;

a second set of threads located about the perimeter of said attachment end of said housing for engaging said first set of threads, forming a threaded connection and attaching said housing to said body portion;

a locking assembly for securing the threaded connection between said first set of threads and said second set of threads to a locked position and;

a clearance opening in said attachment end of said housing for receiving said piston and allowing the piston to remain attached to said rod for tooless changing of the housing.

10. The dispensing tool of claim 9 wherein said locking assembly further comprises at least one projection and at least opening for receiving said projection when in said locked position.

11. The dispensing tool of claim 9 wherein said locking assembly further comprises at least one projection extending from said housing and at least one latch assembly extending from said attachment assembly, the at least one latch assembly having an arcuate detent for receiving said projection when in said locked position.

12. The dispensing tool of claim 10 wherein said first set of threads are located about an internal perimeter of said cap and said second set of threads are located about an external perimeter of said housing.

13. The dispensing tool of claim 12 further comprising a first and a second projection and corresponding to first and second latch assemblies each providing said opening for receiving a respective projection, wherein said first projection and latch assembly is substantially diametrically opposed from said second projection and latch assembly.

14. The dispensing tool of claim 10 wherein said locking assembly further comprises a spring assembly having a spring fixedly attached at a first end to the attachment end of said housing and said projection extending from a second end of said spring such that rotation of the first and/or second sets of threads allows said projection to extend through said opening when achieving said locked position.

15. The dispensing tool of claim 10 wherein said first and second set of threads comprise a double-lead thread connection.

16. The apparatus of claim 15 wherein said housing and attachment assembly are made from a polymeric material.

17. A power dispensing tool for dispensing materials comprising:

a body portion having a handle, trigger, engagement member, and elongated rod connected to a piston such that advancement of said trigger advances the elongated rod through said body portion for the dispensing of material from said power dispensing tool;

a cartridge support tube for housing materials for dispensing, the cartridge support tube having a dispensing end and an attachment end;

an attachment assembly comprising a cap, washer, and connector for attaching the cartridge support tube to said body portion, the cap having a first set of threads about its internal perimeter;

the connector having a threaded portion that extends through openings in said washer and said cap into a corresponding threaded area of said body portion engagement member for attaching the washer and cap to said body portion;

a second set of threads located about the external perimeter of said attachment end of said cartridge support tube for engaging said first set of threads, forming a threaded connection and attaching said cartridge support tube to said body portion; and a locking assembly for securing the threaded connection between said first set of threads and said second set of threads to a locked position, the locking assembly comprising a projection fixedly attached to said cartridge support tube and an opening located in said attachment assembly such that said projection penetrates said opening when in said locked position.

18. The power dispensing tool of claim 17 wherein said opening is in said cap.

19. The power dispensing tool of claim 17 wherein said opening is an arcuate recess between two substantially symmetric inclined latching members.

20. The apparatus of claim 1 wherein said attachment assembly accommodates a plurality of various size housings that form substantially single-turn connection with said attachment assembly for rapid housing interchange.

21. The apparatus of claim 1 wherein said attachment assembly accommodates a plurality of various size housings that form substantially half-turn connection with said attachment assembly for rapid housing interchange.

22. The power dispensing tool of claim 17 further comprising a clearance opening in said attachment end of said support tube for receiving a piston attached to a rod that extends through said body, the clearance opening allowing the piston to remain attached to said rod for tooless changing of the housing.

23. The power dispensing tool of claim 1 wherein said attachment assembly further comprises a low friction spacer that allows for rotation of the cartridge, housing, and attachment assembly during operation.

24. The power dispensing tool of claim 23 wherein said a low friction spacer is coated with one of silicone and Teflon.

25. A power apparatus for dispensing materials that allows for the interchange of different size housings without the use or need of tools, the power apparatus comprising:

a body portion for supporting a rod, the body portion comprising an opening extending from a front side of the body portion to a rear side of the body portion, said opening allowing movement of the rod through said body portion during operation;

a selected one of a plurality of different sized housings having different diameters and/or lengths for supporting varying size cartridges filled with materials for dispensing, the plurality of different sized housings having a dispensing end, an attachment end, and an elongated radial opening for radially receiving varying sized cartridges;

a piston connected to a material engagement end of said rod, the piston being movably positioned outward from the front side of said body portion opening, the piston for engaging and advancing material from the cartridges during operation of the power apparatus; and a uniformly sized attachment assembly for connecting said plurality of different sized housings to said body portion, the attachment assembly comprising a first connecting arrangement located on all of said plurality of different sized housings at said attachment end and a second connecting arrangement located at said front side of said body portion, the first connecting arrangement comprising a first set of threads annularly located about a surface of said first connecting arrangement and the second connecting arrangement comprising a second set of threads annularly located about a surface of said second connecting arrangement, the first and second set of threads forming a threaded connection allowing for the attachment of any one of said plurality of different sized housings to said body portion.

* * * * *